US008517077B2

(12) United States Patent
Payne

(10) Patent No.: US 8,517,077 B2
(45) Date of Patent: Aug. 27, 2013

(54) AUTOMATIC TAPER

(75) Inventor: Robert L. Payne, Lombard, IL (US)

(73) Assignee: Drywall Master Tools, Inc., Forest Park, IL (US)

( * ) Notice: Subject to any disclaimer, the term of this patent is extended or adjusted under 35 U.S.C. 154(b) by 183 days.

(21) Appl. No.: 13/116,706

(22) Filed: May 26, 2011

(65) Prior Publication Data

US 2011/0290422 A1 Dec. 1, 2011

Related U.S. Application Data

(60) Provisional application No. 61/396,367, filed on May 26, 2010.

(51) Int. Cl.
*B32B 37/22* (2006.01)
*B44C 7/02* (2006.01)

(52) U.S. Cl.
USPC ..... 156/577; 156/574

(58) Field of Classification Search
USPC ..... 156/574, 577, 578, 579
See application file for complete search history.

(56) References Cited

U.S. PATENT DOCUMENTS

| | | | | |
|---|---|---|---|---|
| 4,090,914 | A * | 5/1978 | Hauk et al. | 156/523 |
| 4,105,490 | A * | 8/1978 | Lass | 156/526 |
| 4,440,410 | A * | 4/1984 | Bradshaw | 280/47.26 |
| 5,137,386 | A * | 8/1992 | Mower | 401/48 |
| 6,513,562 | B1 * | 2/2003 | Trout | 156/391 |
| 2004/0244916 | A1 * | 12/2004 | Hall et al. | 156/574 |
| 2007/0044923 | A1 * | 3/2007 | Jungklaus et al. | 156/575 |
| 2007/0077114 | A1 * | 4/2007 | Mondloch et al. | 401/48 |

* cited by examiner

*Primary Examiner* — Mark A Osele
(74) *Attorney, Agent, or Firm* — Justin Lampel

(57) ABSTRACT

The invention generally relates to an automatic taper for drywall. More specifically, the invention relates to a manner for accessing the interior of the business end of the automatic taper for drywall. The taper may have an easily removable cover plate which may allow a user to obtain easy access to the interior of the nozzle of the taper. A user may gain access to the interior of the nozzle by flipping a rotating securing bar upward and then removing the removable cover plate.

4 Claims, 5 Drawing Sheets

AUTOMATIC TAPER

REFERENCE TO RELATED APPLICATIONS

The present application is based on U.S. provisional application No. 61/396,367 filed on May 26, 2010, currently co-pending, the entire contents of which are incorporated by reference. Applicant claims the priority benefit of the '367 application.

BACKGROUND OF THE INVENTION

The invention generally relates to an automatic taper for drywall. More specifically, the invention relates to a manner for accessing the interior of the business end of the automatic taper for drywall. The taper may have an easily removable cover plate which may allow a user to obtain easy access to the interior of the nozzle of the taper. A user may gain access to the interior of the nozzle by flipping a rotating securing bar upward and then removing the removable cover plate.

Drywall tapers have been around for a long time. For example, U.S. Pat. No. 4,828,647 to Eccleston discloses a taper for applying tape and mastic to joints between prefabricated wall sections such as gypsum board comprising a tubular housing which holds a supply of mastic, a main drive roller mounted at the forward end of the housing which rotates by friction as it is moved along a wall and tape drive roller means operated by the main drive roller and which feeds the tape forwardly.

U.S. Pat. No. 6,513,562 to Trout discloses a unitary nozzle for use in a taping apparatus. The unitary nozzle features a cradle section adjacent a tube receiving section and a flange for sealingly receiving a mastic tube. A mastic is extruded and contained along a path extending along one side of the tape and between a front and rear end of the nozzle.

U.S. Pat. No. 4,086,121 to Ames discloses a self-contained dry wall taper has a hollow elongated body for holding mastic and supports a roll of tape with tape feeding means to deliver the tape to tape applying wheels that in turn apply it to cover a joint between two wall board sections. A piston is slidably mounted in the hollow body and is automatically moved by a mechanism actuated by the rotating wheels, as they are moved over the wall board surface, to force a layer of mastic onto the tape just prior to it being applied to the surface. Novel tape feeding and tape cutting means are actuated by a single sleeve which is moved forwardly on the hollow body to initially feed the tape into engagement with the tape applying wheels and is moved rearwardly to actuate the tape-cutting mechanism for cutting the tape. A tape creasing disc can be swung into operative position by the operator when the tape is to be applied to an inner corner of a room and it is desired to provide a median crease along the length of the tape and for forcing this crease into the room corner as the mastic and tape are applied.

However, these existing automatic tapers fail to allow a user to obtain easy access to the interior portion of the nozzle of taping tool for cleaning and/or repairing the taping tool. More specifically, these existing automatic tapers generally require the removal of (usually) at least four screws in order to remove the cover plate. The automatic taper of the present invention allows a user to save time by removing the removable cover plate in a quick and efficient manner. A need, therefore, exists for an improved automatic taper which allows a user to easily, cheaply and conveniently apply gain access to the interior of the taping device.

SUMMARY OF THE INVENTION

The invention generally relates to an automatic taper for drywall. More specifically, the invention relates to a manner for accessing the interior of the business end of the automatic taper for drywall. The taper may have an easily removable cover plate which may allow a user to obtain easy access to the interior of the nozzle of the taper. A user may gain access to the interior of the nozzle by flipping a rotating securing bar upward and then removing the removable cover plate.

The automatic taper is used to provide tape to joints between pre-fabricated drywall. An advantage of the device is to provide a light weight and convenient automatic taper.

A further advantage of the device is to provide an automatic taper which allows a user to gain quick access to the interior of the automatic taper.

Another advantage of the device is to provide an automatic taper which can be used with interchangeable industry parts.

A further advantage of the present invention is that the easy removal of the removable cover plate allows for a quick and easy manner in which the device may be properly cleaned and/or repaired.

For a more complete understanding of the above listed features and advantages of the automatic taper, reference should be made to the following detailed description of the preferred embodiments and to the accompanying drawings. Further, additional features and advantages of the invention are described in, and will be apparent from, the detailed description of the preferred embodiments and from the drawings.

DETAILED DESCRIPTION OF THE PREFERRED EMBODIMENTS

The invention generally relates to an automatic taper for drywall. More specifically, the invention relates to a manner for accessing the interior of the business end of the automatic taper for drywall. The taper may have an easily removable cover plate which may allow a user to obtain easy access to the interior of the nozzle of the taper. A user may gain access to the interior of the nozzle by flipping a rotating securing bar upward and then removing the removable cover plate.

Figure 1:
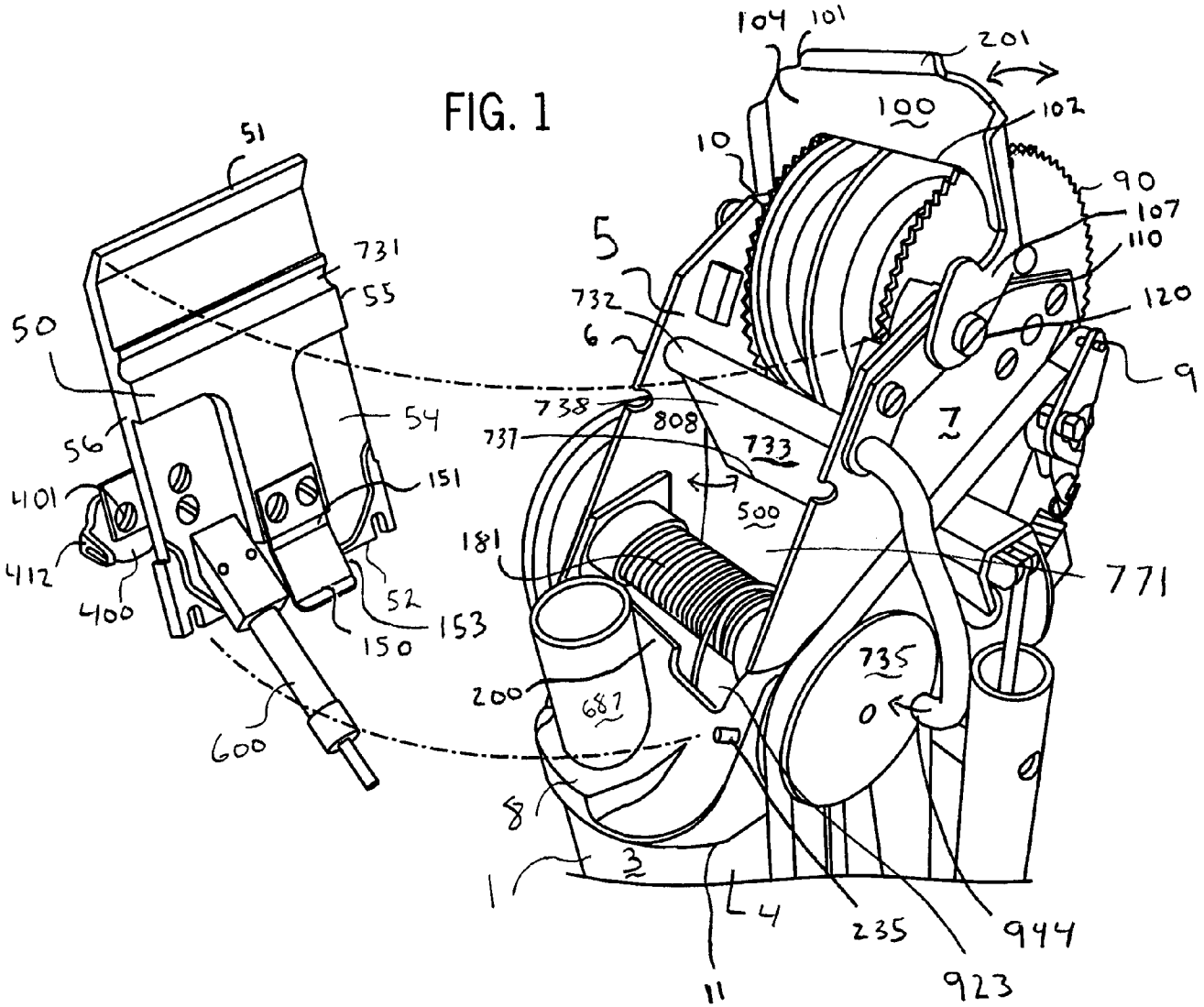
FIG. 1 illustrates a side perspective view of the automatic taper wherein the removable cover plate is removed from the nozzle of the taper (First Position A).

Referring now to FIG. 1, the automatic taper 1 may have a first end (not visible), a second end 3 and a body having a generally hollow interior 4. The body of the taper 1 may be a desired length to, for example, stretch to reach high ceilings or contact nearby finishes in a room. Typically, the automatic taper 1 would be constructed from largely metal components which are secured together by screws and the like; however, it should be noted that the device may be constructed from any suitable material aside from metal. The first end of the automatic taper 1 may be the portion of the device which the user grasps and controls the functions of the taper 1 while the second end 3 of the automatic taper 1 may be the business end of the automatic taper 1 and may have a nozzle 5 for securing mud 20 and tape to a joint in drywall.

The nozzle 5 may generally have a first side 6, a second side 7, a front 8, a back 9, a top 10 and a bottom 11. The bottom 11 of the nozzle 5 may be attached to the second end 3 of the body of the taper 1 and may be in communication with the body such that a user can control the nozzle 5 from a hand grip (not shown) near the first end of the body. Further, the bottom 11 of the nozzle 5 may be open such that mud 20 may travel from the generally hollow interior 4 of the body up to and through the nozzle 5. Preferably, the body 4 of the taper 1 is cylindrical; however, the body of the taper 1 may be of any suitable shape.

Located near the front 8 of the nozzle 5 may be a generally cylindrical tube 687. The generally cylindrical tube 687 may be the inlet tube for pumping mud 20 into the interior of the taper 1 during use. The generally cylindrical tube 687 may be connected to a supply line (not shown).

Located within the hollow interior 4 of the body of the taper 1 may be a passageway 19 for mud 20 (or mastic) to travel. More specifically, the mud 20 may move upward from the first end of the automatic taper 1 toward the second end 3 of the automatic taper 1. A supply line of new mud 20 may constantly replace the mud 20 as it moves from the first end to the second end 3 of the taper 1 and out of the nozzle 5 (as will be discussed below) and into the drywall board joint. The nozzle 5 may be used to apply both tape and mud 20 to the joint between two pre-fabricated drywall boards.

Temporarily located near the front 8 of the nozzle 5 may be a removable cover plate 50. The removable cover plate 50 may guide the mud 20 as it moves through the nozzle 5 and may protect an interior 500 of the nozzle 5 from damage. The cover plate 50 may have a top 51, a bottom 52, a front 53 (FIG. 2), a back 54, a first side 55 and a second side 56. While inserted on the nozzle 5 of the taper 1 (in the Second Position B), the back 54 of the removable cover plate 50 may face the top 10/front 8 of the nozzle 5 such that a portion of the front 8 of the nozzle 5 is not visible when the removable cover plate 50 is in place on the nozzle 5 in the Second Position B.

In order to gain access to the interior 500 of the nozzle 5 for cleaning and/or repair of the nozzle 5 and taper 1, the removable cover plate 50 must be removed. When the removable cover plate 50 is in the First Position A (removed from the nozzle 5), an interior 500 of the nozzle 5 is then exposed. More specifically, the interior 500 of the nozzle 5 of the taper 1 is largely concealed while the removable cover plate 50 is in the Second Position B (secured to the nozzle 5).

Figure 4:
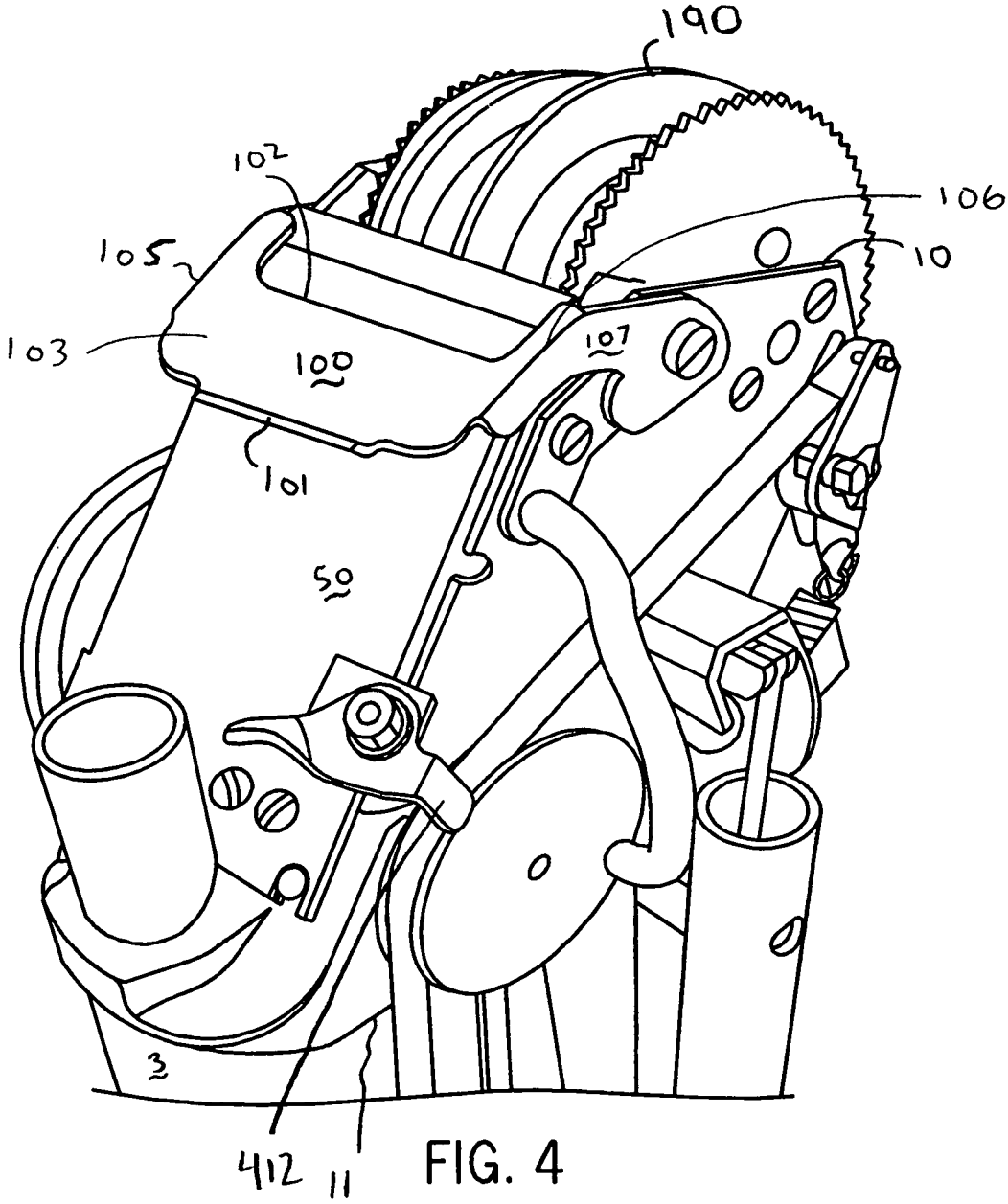
FIG. 4 illustrates a side perspective view of the automatic taper with the securing bar secured over the removable cover plate (Second Position B).

Located near the top 10 of the nozzle 5 may be a rotating securing bar 100. The rotating securing bar 100 may have a largely flat pressing plate and may rotate from a First Position A (FIG. 1) to a Second Position B (FIG. 4). The pressing plate of the securing bar 100 may have a top 101, a bottom 102, a front 103 (FIG. 4), a back 104, a first side 105 and a second side 106. The pressing plate of the first side 105 and the second side 106 of the securing bar 100 may each have an extended arm portion 107 which may extend backward from the back 104 of the pressing plate at approximately 100-140 degrees with respect to the back 104 of the pressing plate. The extended arms 107 of the securing bar 100 may each have a hole 110 wherein the holes 110 rotate around a securing pin 120 which is secured to the nozzle 5. The securing pins 120 may be permanently or temporarily secured to the nozzle 5 of the automatic taper 1. The rotating securing bar 100 may rotate approximately 115-155 degrees. More specifically, when the securing bar 100 is rotated fully upward (in the First Position A), the bottom 102 of the securing bar 100 contacts and is stopped by the rotating wheels 90 (as described below). When the securing bar 100 is rotated fully downward, the back 104 of the pressing plate contacts and is stopped from moving by either the removable cover plate 50 (if the removable plate 50 is secured on the nozzle 5) or by a brace 348 (FIG. 2) of the nozzle 5 if the removable cover plate 50 is removed from the nozzle 5.

When the rotating securing bar 100 is in the Second Position B (and the removable cover plate 50 is in the Second Position B), the generally flat back 104 of the pressing plate of the rotating securing bar 100 may be largely parallel to and flush with the front 53 of the removable cover plate 50. Further, when the rotating securing bar 100 is in the Second Position B, the generally flat back 104 of the pressing plate covers a portion of the front 53 of the cover plate 50. The length of the pressing plate is substantially similar to the width of the removable cover plate. As a result, the removable cover plate 50 is secured into position on the nozzle 5 and is prevented from being removed.

When the rotating securing bar 100 is rotated upward to the First Position A, none of the securing bar 100 is located on top of or contacts the removable cover plate 50 and the removable cover plate 50 may be easily removed from the nozzle 5 of the taper 1 without the need to unscrew the cover plate 50. The user may then remove the cover plate 50 to, for example, clean and/or replace the cover plate 50 or clean and/or replace portions of the interior 500 of the nozzle 5 or taper 1. Once a new or cleaned cover plate 50 is reinserted, the securing bar 100 may be rotated downward to the Second Position B and the cover plate 50 is again secured on the nozzle 5 and the automatic taper 1 is ready for continued use.

The pressing plate of the top 101 of the rotating securing bar 100 may have an extended lip portion 201. The extended lip portion 201 may be generally flat and may extend off of the top 101 of the main surface of the pressing plate in a planar surface distinct from the axis of the main surface of the pressing plate. The extended lip portion 201 may allow a user to easily grasp and move the rotating securing bar 100 from the First Position A to the Second Position B and vice versa.

A spring 150 may be attached to the cover plate 50. The spring 150 may be generally square-shaped and may extend off the back 54 of the cover plate 50 near the bottom 52 of the cover plate 50. The spring 150 may be formed such that a crease 151 (which runs parallel to the bottom 52 of the cover plate 50) on the spring 150 provides tension and resistance when a force is applied to the spring 150. A space 153 may be present between the spring 150 and the back 54 of the cover plate 50.

The front 8 of the nozzle 5 may have an extended lip portion 200. The extended lip portion 200 may be largely rectangular and may extend upward from the nozzle 5 in a largely parallel position with respect to the body of the taper 1. While the removable cover plate 50 is inserted on the nozzle 5 in the Second Position B, the extended lip portion 200 occupies the space 153 between the spring 150 and the back 54 of the removable cover plate 50. The spring 150 therein provides a force slightly pulling the removable cover plate 50 inward, toward from the nozzle 5; therein better securing the removable cover plate 50 to the nozzle 5.

A first indentation 233 (FIG. 6) and a second indentation 234 (FIG. 6) may be present on the bottom 52 of the removable cover plate 50. The first indentation 233 and second indentation 234 may be semi-circular and may each surround a separate bolt 235 (FIG. 1) located on the nozzle 5 when the removable cover plate 50 is inserted on the nozzle 5 in the Second Position B. As a result, the first indentation 233 and second indentation 234 may further help secure the removable cover plate 50 to the nozzle 5 while the taper 1 is being used and may further prevent unwanted movement or shifting of the removable cover plate 50 with respect to the nozzle 5 during use. In addition, the bolts 235 and first and second indentation 233/234 help align the removable cover plate 50 on the nozzle 5 during use.

Typically, users of existing automatic taping devices are required to remove a plurality of screws (usually at least 4) located on the front 53 of the removable cover plate 50 in order to gain access to the interior 500 of the nozzle 5 for cleaning and/or repair of the taper 1 (such as replacing or fixing a chain 181) or cover plate 50. These screws directly secure the removable cover plate 50 to the nozzle 5. This process is time consuming and can greatly slow up the construction process. In the present device, by simply moving the rotating securing bar 100 downward (to the Second Position B) over the removable cover plate 50, the need to screw in the removable cover plate 50 is eliminated and the cover plate 50 may be secured easily to the nozzle 5 without screws. Likewise, in the present device, the user may simply rotate the securing bar 100 upward from the Second Position B to the First Position A to remove the removable cover plate 50 for cleaning and or replacing of the cover plate 50 and/or the nozzle 5.

Located near the top 10 of the nozzle 5 may be, for example, three rotating wheels 90. The rotating wheels 90 may allow the user to roll the tape onto the wall board. The rotating wheels 90 may rotate with an axis perpendicular to the length of the body of the automatic taper 1. Further, the rotating wheels 90 may be situated such that the flat circular sides of the wheels 90 are parallel with respect to the sides of the nozzle 5 of the automatic taper 1 (as shown in the figures). The two exterior rotating wheels 90 may have serrated teeth 95 while the center rotating wheel 190 may be smooth and not intended for cutting. The rotating wheels 90 may allow the tape of the taper to be applied to a wall smoothly. A rotating axle 175 (FIG. 2) may run through the rotating wheels 90 such that all three blades rotate together. The rotating axle 175 may be secured on both sides to the nozzle 5.

Within the interior 500 of the nozzle 5 is a chain 181. When uncoiled, the chain 181 may run largely parallel with respect to the body of the taper. More specifically, the chain 181 may run along the inside of the body of the taper 1 and may have a coiled portion within the interior 500 of the nozzle 5 for controlling the length of the free chain 181. The rotating axle 175 may be in communication with the chain 181, which may allow a user to control the speed at which the rotating wheels 90 rotate with respect to the nozzle 5.

Located on the first side 55 of the removable cover plate 50 may be an adjustable locking device 400. The adjustable locking device 400 may rotate around a pin 401 connected to the removable cover plate 50. The adjustable locking device 400 may help to further secure the removable cover plate 50 to the nozzle 5 while the removable cover plate 50 is inserted on the nozzle 5 during use of the taper 1. An extended lip 412 may extend substantially perpendicular with respect to the main body of the adjustable locking device 400. The extended lip 412 may cover a portion of the second side 7 of the nozzle 5 while the removable cover plate 50 is inserted on the nozzle 5 in the Second Position B therein further securing the removable cover plate 50 to the nozzle 5.

Figure 5:
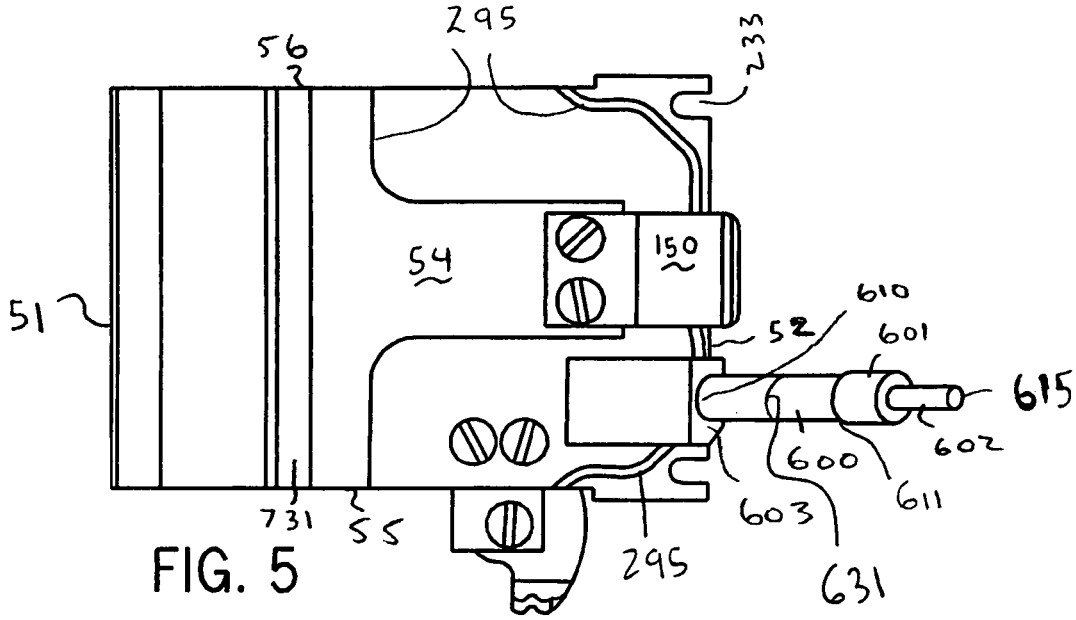
FIG. 5 illustrates a back plan view of the cover plate.
Figure 6:
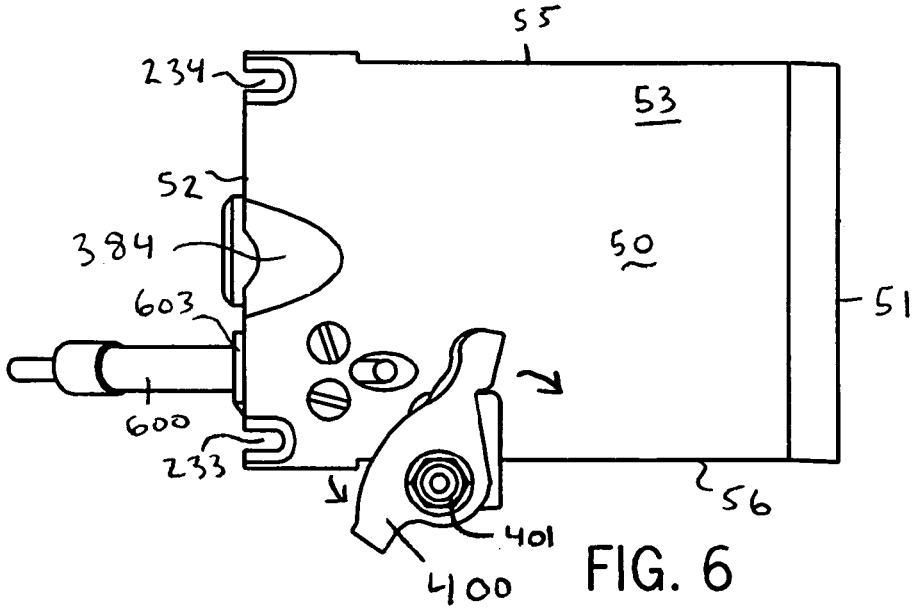
FIG. 6 illustrates a front plan view of the cover plate.

Referring now to FIGS. 5 and 6, a shaft 600 may be permanently secured to the removable cover plate 50. The shaft 600 may have a first end 610 and a second end 611 and may be generally cylindrical. The first end 610 of the shaft 600 may be secured to a brace 603. The brace 603 may be permanently secured to the back 54 of the removable cover plate 50 near the bottom 52 of the removable cover plate 50. The shaft 600 may have a generally cylindrical ring 601 which may be slightly larger than a circumference 631 of the shaft 600. The generally cylindrical ring 601 may have an extended rod 602 having a circular flat surface 615 at the distal end of the extended rod 602.

While the removable cover plate 50 is being inserted onto the nozzle 5 for use, the extended rod 602 of the shaft 600 may be inserted into the interior 500 of the nozzle 5 and the circular flat surface 615 of the extended rod 602 may contact and engage a generally circular piston 923 within the interior 500 of the nozzle 5. When the piston is engaged, the chain 181 may be moved and the taper may be filled with mud 20 for application of the same onto the tape and wall. When the removable cover plate 50 is removed from the nozzle 5 (in the First Position A), the extended rod 602 does not contact the piston 923 and the taper 1 is not usable.

A sealing gasket 295 may run along a portion of the back side 54 of the removable cover plate 50. The sealing gasket 295 may create a seal between a portion of the back 54 of the removable cover plate 50 and a portion of the nozzle 5. The sealing gasket 295 may prevent the unwanted escape of mud 20 (or mastic) from the interior 500 of the nozzle 5 from various locations. The sealing gasket 295 may run under the spring 150; between the spring 150 and the back 54 of the removable cover plate 50.

An indentation 384 may be present on the front 53 of the removable cover plate 50. The indentation 384 may be located at the bottom 52 of the removable cover plate 50 and may be generally in the shape of a half oval wherein the center portion of the indentation 384 is deeper than the edge portions of the indentation 384. The indentation 384 may correspondingly fit snuggly around a portion of the generally cylindrical tube 687 while the removable cover plate 50 is inserted on the nozzle 5. Accordingly, the indentation 384 may reduce the overall size of the nozzle 5 needed to accommodate a standard inlet cylindrical tube 387.

When the removable cover plate 50 is inserted and located into position on the nozzle 5, the mud 20 within the interior 500 of the nozzle 5 and the taper 1 may be forced to exit the nozzle 5 at the top 51 of the removable cover plate 50 near the rotating wheels 90.

A ridge 731 may run along the back 54 of the removable cover plate 50. The ridge 731 may be semi-circular and may run parallel with respect to the top 51 and bottom 52 of the removable cover plate 50. The semi-circular shape of the ridge 731 may correspondingly fit a bar 732 located partly within the interior 500 of the nozzle 5. While the removable cover plate 50 is inserted on the nozzle 5 in the Second Position B, the bar 732 may fit snugly within the ridge 731 and may create a liquid-tight seal. The bar 732 of the nozzle 5 may be permanently connected to a generally rectangular plate 733. More specifically, the generally rectangular plate 733 may have a top 736 (FIG. 2), a bottom 737, a front 738, a back (not visible), a first side and a second side. The top 736 of the generally rectangular plate 733 may be secured to the bar 732 while the sides, front 738, back and bottom 737 may pivot and rotate with respect to the top 736 of the generally rectangular plate 733.

While the bar 732 is rotated forward in the ridge 731, the front 738 of the generally rectangular plate 733 rotates forward, toward the back 54 of the removable cover plate 50. In this position, mud 20 located within the nozzle 5 and the body of the taper 1 may flow out of the nozzle 5 and onto the wall or tape.

When the bar 732 of the device is slightly rotated backward within the ridge 731, the generally rectangular plate 733 rotates backward. More specifically, the bottom 737 of the generally rectangular plate 733 therein rotates away from the back 54 of the removable cover plate 50 and toward the center of the nozzle 5. In an embodiment, the bottom 737 of the generally rectangular plate 733 contacts a generally flat shield 771 within the interior 500 of the nozzle 5. The sides of the generally rectangular plate 733 contact an inner wall 808 of the sides 6/7 of the nozzle 5 therein creating a seal. The shield 771 therein directs the mud 20 out of the nozzle 5 while the device is in use. When the device is not in use, an opening between the shield 771 and the generally rectangular plate 733 is eliminated and mud 20 may not flow out of the nozzle 5. More specifically, in this position, the mud 20 within the nozzle 5 and/or body of the taper 1 is prevented from exiting the nozzle 5 and the taper 1 is non-functional.

The bar 732 may extend out of the interior 500 of the nozzle 5 and may have a distal end 944 located near a wheel 735. The bar 732 may be moved forward or backward to control the generally rectangular plate 733 located within the interior 500 of the nozzle 5. The wheel 735 may be manually rotated (or via a level) to control the chain 181 located within the interior 500 of the nozzle 5.

Figure 2:
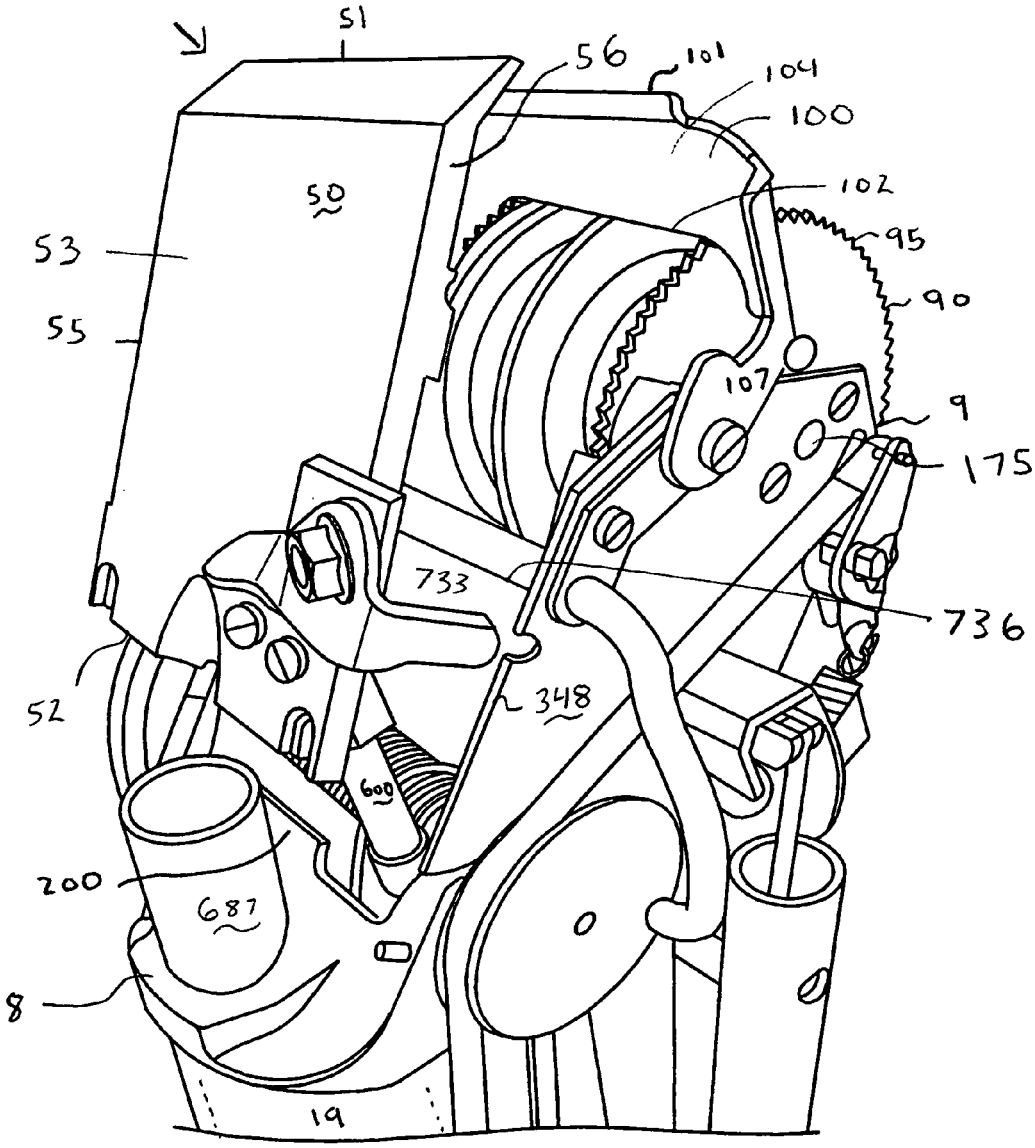
FIG. 2 illustrates a side perspective view of the automatic taper wherein the removable cover plate is being inserted onto the nozzle of the taper.
Figure 3:
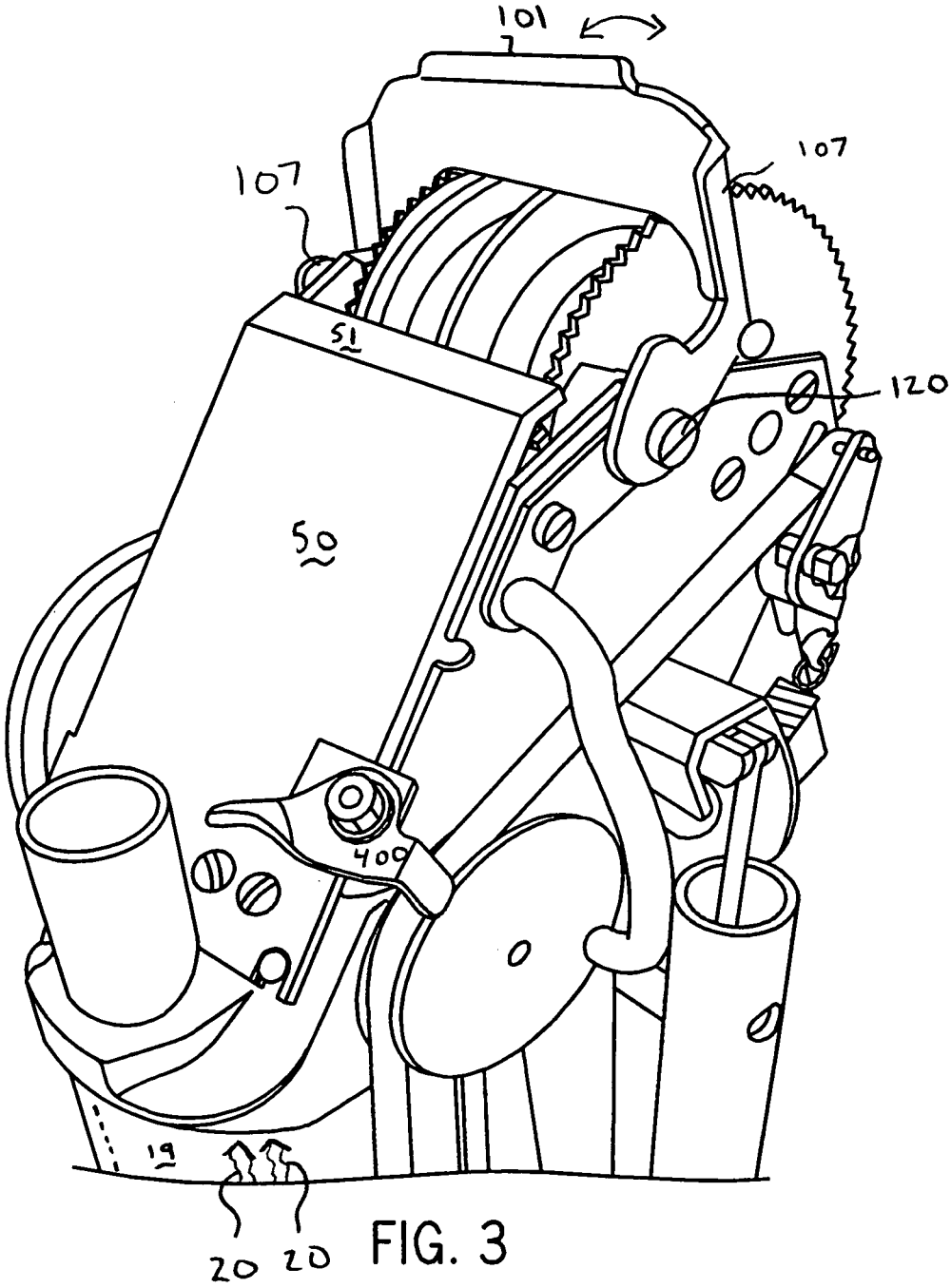
FIG. 3 illustrates a side perspective view of the automatic taper wherein the removable cover plate is inserted on the nozzle of the taper.

Referring again to FIG. 1, the removable cover plate 50 may be removed from the nozzle 5 for cleaning and/or replacing of the removable cover plate 50 and/or the taper 1. To insert the removable cover plate 50 onto the nozzle 5, the securing bar 100 is moved upward allowing the removable cover plate 50 to be placed on the nozzle 5. Referring to FIG. 2, the removable cover plate 50 is brought near the nozzle 5; placing the shaft 600 partly within the interior 500 of the nozzle 5. Referring now to FIG. 3, the removable cover plate 50 is pushed inward onto the nozzle 5. Referring now to FIG. 4, the securing bar 100 is rotated downward to partly cover and secure the removable cover plate 50 to the nozzle 5. The adjustable locking device 400 may then be rotated so that the extended lip 412 of the adjustable locking device 400 comes into contact with the side 7 of the nozzle 5 therein further securing the removable cover plate 50 to the nozzle 5. The process is reversed to remove the cover plate 50 from the nozzle 5 of the taper 1.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages. It is, therefore, intended that such changes and modifications be covered by the appended claims.

The invention claimed is:

1. An automatic taper for drywall comprising:

a generally cylindrical body having a first end and a second end;

a nozzle having a top, a bottom and an interior wherein the bottom of the nozzle is attached to the second end of the body;

a removable cover plate temporarily secured to the nozzle wherein the removable cover plate directs a mud or mastic through the interior of the nozzle;

wherein the removable cover plate has a top, a bottom, a front, a back, a first side and a second side and wherein the back of the removable cover plate faces the interior of the nozzle while the removable cover plate is secured to the nozzle; and a brace located on the back of the removable cover plate wherein a shaft extends outward from the brace and wherein the shaft has a generally flat circular surface which contacts a piston and wherein the movement of the piston activates the taper.

2. An automatic taper for drywall comprising:

a generally cylindrical body having a first end and a second end;

a nozzle having a top, a bottom and an interior wherein the bottom of the nozzle is attached to the second end of the body;

a removable cover plate temporarily secured to the nozzle wherein the removable cover plate directs a mud or mastic through the interior of the nozzle; and an adjustable locking device located on a side of the removable cover plate wherein the adjustable locking device has an extended lip portion which contacts and secures the removable cover plate to the nozzle while the removable cover plate is located on the nozzle.

3. An automatic taper for drywall comprising:

a generally cylindrical body having a first end and a second end;

a nozzle having a top, a bottom, a first side and a second side and an imerior wherein the bottom of the nozzle is attached to the second end of the body;

a removable cover plate having a length and width temporarily secured to the nozzle wherein the removable cover plate directs a mud or mastic through the interior of the nozzle;

a single rotating securing bar comprising: a pressing plate having a length, a front, and a back; a first extended arm and a second extended arm wherein the first extended arm of the rotating securing bar is secured to the first side of the nozzle and wherein the second extended arm of the rotating securing bar is secured to the second side of the nozzle and wherein the rotating securing bar rotates from a First Position to a Second Position and wherein the back of the pressing plate contacts the removable cover plate and prevents the removable cover plate from being removed from the nozzle in the Second Position and wherein the pressing plate is not in contact with the removable cover plate in the First Position and wherein the removable cover plate may be removed from the nozzle while the rotating securing bar is in the First Position; and wherein the length of the pressing plate is substantially similar to the width of the removable cover plate.

4. An automatic taper for drywall comprising:

a generally cylindrical body having a first end and a second end;

a nozzle having a top, a bottom and an interior wherein the bottom of the nozzle is attached to the second end of the body;

a removable cover plate temporarily secured to the nozzle wherein the removable cover plate directs a mud or mastic through the interior of the nozzle;

wherein the removable cover plate has a top, a bottom, a front, a back, a first side and a second side and wherein the back of the removable cover plate faces the interior of the nozzle while the removable cover plate is secured to the nozzle; and a semi-circular ridge located on the back of the removable cover plate wherein the semi-circular ridge accepts a corresponding bar located partly within the interior of the nozzle and wherein the bar may rotate within the semi-circular ridge and wherein the bar forms a liquid-tight seal with the semi-circular ridge while the removable cover plate is secured on the nozzle.

* * * * *